US005226643A

United States Patent [19]

Kriegel et al.

[11] Patent Number: 5,226,643

[45] Date of Patent: Jul. 13, 1993

[54] SHEET TRANSPORT AND ALIGNMENT APPARATUS WITH A SELF-ALIGNING EDGE-GUIDE

[75] Inventors: Jon Kriegel, Rochester; Morris A. Annis, Scottsville, both of N.Y.

[73] Assignee: Eastman Kodak Company, Rochester, N.Y.

[21] Appl. No.: 807,916

[22] Filed: Dec. 16, 1991

[51] Int. Cl.[5] ..... B65H 9/16

[52] U.S. Cl. ..... 271/250

[58] Field of Search ..... 271/248, 250, 251

[56] References Cited

U.S. PATENT DOCUMENTS

| | | | |
|---|---|---|---|
| 3,929,327 | 12/1975 | Olson | 271/250 |
| 3,945,636 | 3/1976 | Kockler et al. | 271/251 X |
| 4,060,237 | 11/1977 | Degen et al. | 271/250 X |
| 4,359,219 | 11/1982 | Garavuso | 271/236 |
| 4,401,302 | 8/1983 | Hardy et al. | 271/251 |
| 4,505,471 | 3/1985 | Stockburger et al. | 271/251 |
| 4,546,964 | 10/1985 | Linthout | 271/250 |
| 4,607,835 | 8/1986 | Wilson et al. | 271/251 X |
| 4,637,602 | 1/1987 | Gavaghan et al. | 271/238 |
| 4,657,239 | 4/1987 | Ikesue et al. | 271/227 |
| 4,767,116 | 8/1988 | Eberle | 271/238 |
| 4,836,527 | 6/1989 | Wong | 271/251 |
| 4,844,440 | 7/1989 | Gray | 271/266 |
| 4,884,097 | 11/1989 | Giannetti et al. | 355/23 |
| 5,080,345 | 1/1992 | Daniels | 271/248 X |

FOREIGN PATENT DOCUMENTS

| | | | |
|---|---|---|---|
| 655937 | 1/1963 | Canada | 271/250 |
| 188240 | 9/1985 | Japan | 271/250 |

OTHER PUBLICATIONS

Heath, "Paper Feed Mechanism", Nov. 1979, IBM Tech. Disclosure Bulletin, vol. 22, No. 6, p. 2496.

*Primary Examiner*—Robert P. Olszewski
*Assistant Examiner*—Boris Milef
*Attorney, Agent, or Firm*—J. Gary Mohr

[57] ABSTRACT

A sheet transport and aligning apparatus that engages with a sheet to shift the sheet laterally during forward transport of the sheet by a roller. The lateral shift brings the sheet into engagement with a light weight pivotal edge guide which aligns to the sheet to establish a line contact with the sheet as the sheet is driven by the conical drive roller. By continuing to drive the sheet, the sheet pivots with the light weight pivotal edge guide until the sheet is in cross-track and skew alignment.

3 Claims, 6 Drawing Sheets

SHEET TRANSPORT AND ALIGNMENT APPARATUS WITH A SELF-ALIGNING EDGE-GUIDE

BACKGROUND OF THE INVENTION

The present invention relates to an apparatus for conveying sheets along a conveying path. The conveying path is bordered, on one side, by a light weight pivotal edge guide or a light weight pivotal edge guide and a fixed edge guide for controlling sheet cross-track and skew alignment.

Devices for advancing sheets over a conveying path, while bringing an edge of such sheets into contact with a fixed abutment to obtain cross-track and skew alignment, are known in the art. An example of this is disclosed in U.S. Pat. No. 4,546,964. In this patent, a conical member having flexible fingers is rotated about an axis extending orthogonal to the sheet conveying path. The flexible fingers exert a force, on the sheets, causing the sheets to advance both along the conveying path and laterally of the conveying path toward a fixed abutment or edge guide.

In U.S. Pat. No. 4,884,097 the fingers of the conical member in U.S. Pat. No. 4,546,946 are replaced by an undercut. The undercut permits compression of the roller, as it contacts and transports the sheet, thereby providing a component in the cross-track direction for moving the sheet laterally toward the abutment or fixed edge guide.

The above systems, while providing a simple means to obtain alignment, use fixed abutments or edge guides to obtain such alignment. Fixed abutments or edge guides, however, have a tendency to damage or mar sheets as the sheets make point contact with the fixed abutments or edge guides, no matter how gentle the drive system.

SUMMARY OF THE INVENTION

An object of the present invention is to provide a simple apparatus for lateral alignment of sheets, that protects against sheet damage or marring normally caused by point contact with a fixed abutment or edge guide.

The above object is accomplished by an apparatus comprising a support surface defining a generally planar sheet transport surface extending in a predetermined direction of sheet travel. A pivotal edge guide means mounted on one side of the support surface for aligning the sheet in the predetermined direction of sheet travel and a drive system for moving said sheet in a lateral, skew and in-track direction in relation to the predetermined direction of sheet travel.

The invention, and its objects and advantages, will become more apparent in the detailed description of the preferred embodiment presented below.

DESCRIPTION OF THE PREFERRED EMBODIMENT

In describing the preferred embodiment of the instant invention, reference is made to the drawings, wherein like numerals indicate like parts and structural features in the various views, diagrams and drawings.

Figure 1:
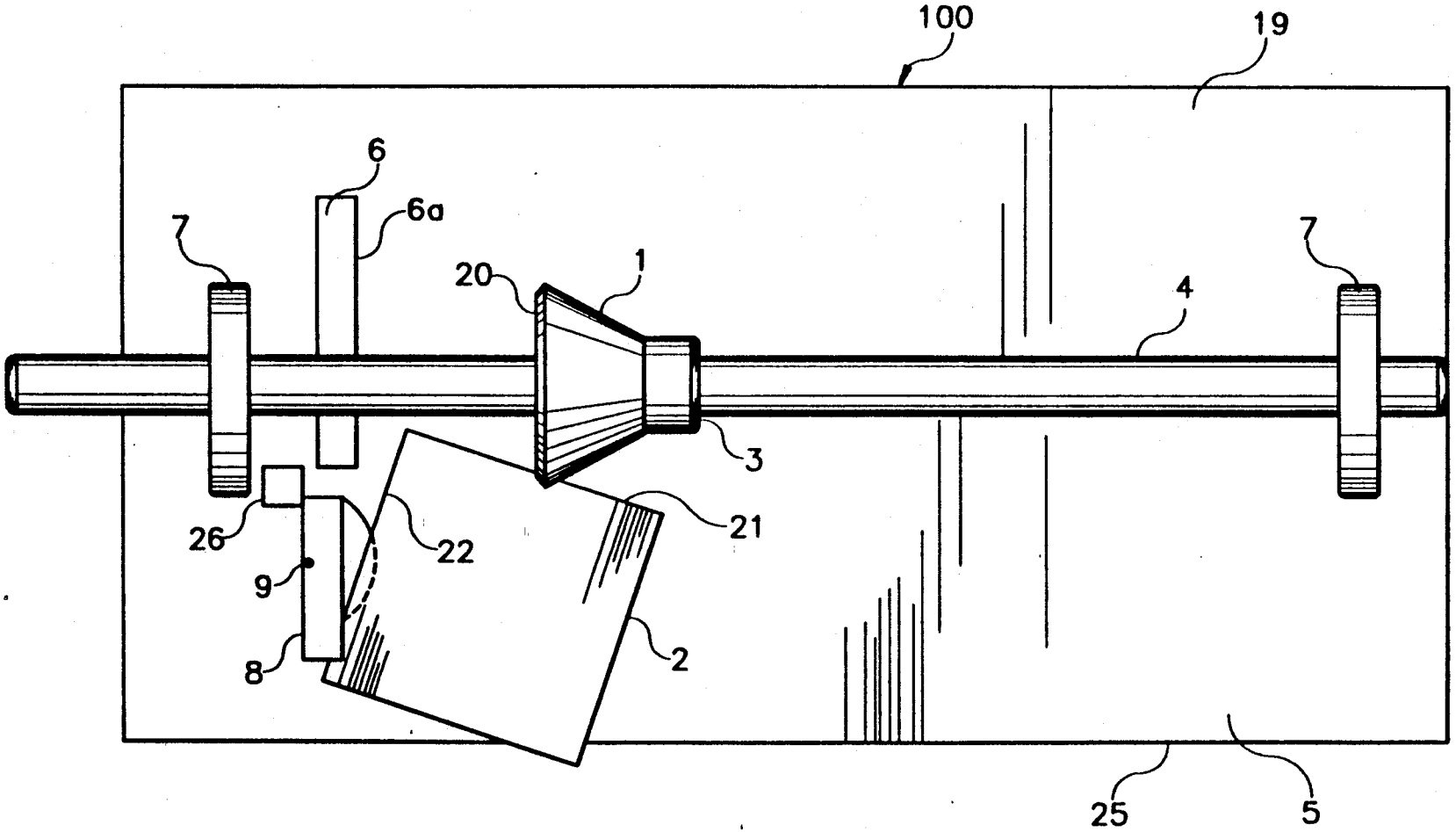
FIG. 1 is a top schematic view of the feed roller and the edge guides in accordance with the present invention.

Referring now to FIG. 1, a sheet transport and alignment apparatus is generally indicated by the numeral 100 and includes a generally planar sheet support surface 5 upon which a sheet 2 is transported, be it an original document or a blank sheet that is to have an image transferred to it. Apparatus of this type are typically utilized with copiers, printers and scanners where there is a need to transport sheets, in a set alignment, past an exposure station or an optical read head, not shown, but known in the art, to expose or read information from sheet 2 as sheet 2 is transported past the exposure station or read head. Apparatus of this type are also typically utilized with copiers, printers and scanners where there is a need to transport sheets, in a set alignment, past a transfer station, not shown, but known in the art, to transfer information onto sheet 2 as sheet 2 is transported past the transfer station.

In applications, such as above stated, it is essential that sheet 2 be properly aligned when it passes the exposure station, read head or transfer station. Therefore, if sheet 2 is received misaligned at receiving end 25, of support surface 5, the system must provide a means to correct this misalignment before sheet 2 reaches the exposure station, read head or transfer station. This alignment is accomplished, in the present invention, by a sheet drive means capable of driving sheet 2 forward along support surface 5 and lateral of support surface 5, such as by having sheet 2 pinched between support surface 5 and a resilient conical drive roller 1, so that as conical drive roller 1 rotates, sheet 2 is transported along support surface 5.

Figure 4:
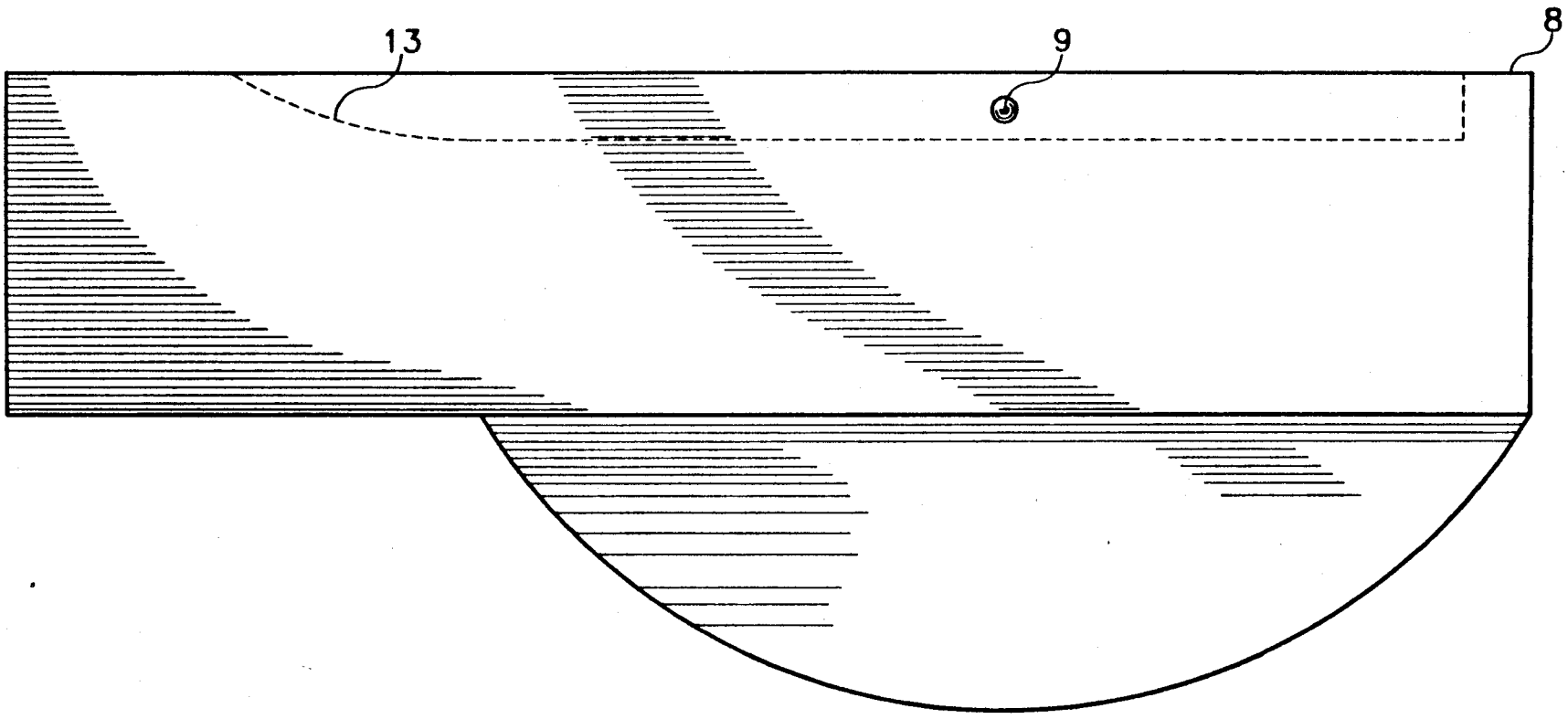
FIG. 4 is a top schematic view of the pivotal edge guide in accordance with the present invention.

In one embodiment of the invention, bounding support surface 5, on one side, are a light weight pivotal edge guide 8, see FIG. 4, and a fixed edge guide 6 which, in cooperation with conical drive roller 1, correct any misalignment of sheet 2, as hereinafter explained.

In another embodiment of the invention, not shown, bounding support surface 5, on one side, is a pivotal edge guide 8 as opposed to the combination of fixed edge guide 6 and pivotal edge guide 8.

Figure 5:
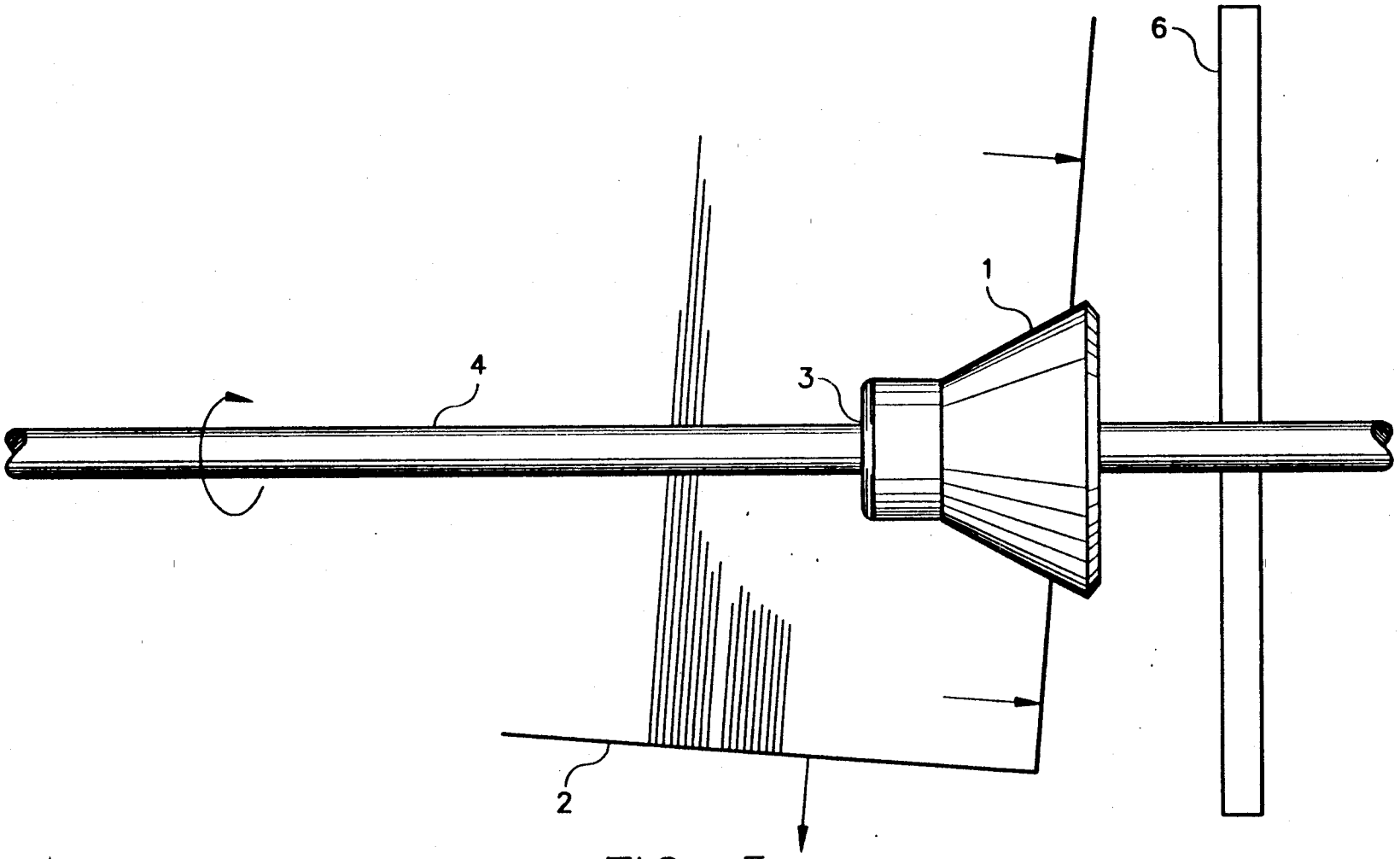
FIG. 5 is a top view of the conical drive roller in accordance with the present invention.
Figure 6A:
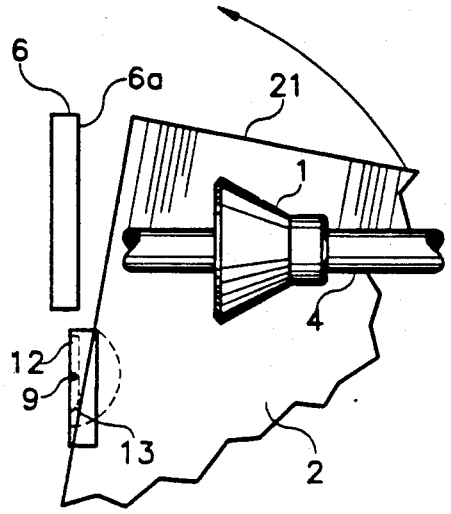
FIGS. 6(*a*) through 6(*d*) are step illustrations, in accordance with the present invention, of the changing relationship between the sheet and the pivotal edge guide, as the sheet is fed by the conical drive roller.
Figure 6B:
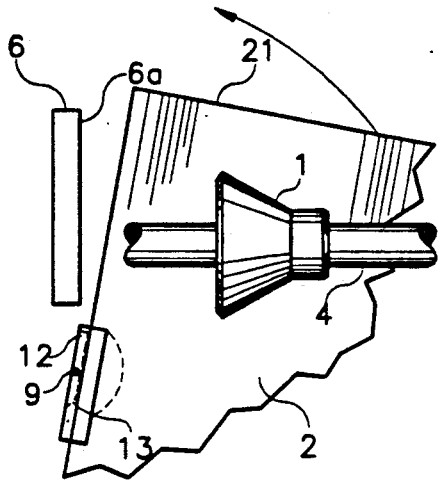
Figure 6C:
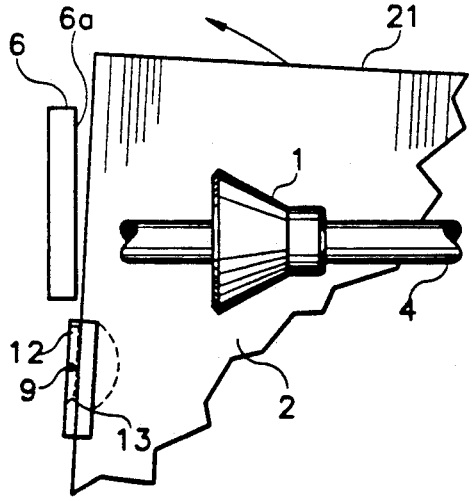
Figure 6D:
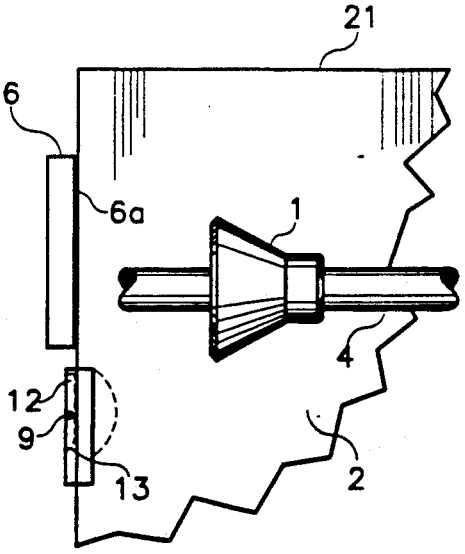

Conical drive roller 1, preferably of a coated foamed urethane material, as shown in FIG. 5, is mounted, through its center 3, for rotation with a shaft 4. Shaft 4 is mounted in bearing plates 7, located on support surface 5, as shown in FIG. 1, such that shaft 4 is orthogonal to the in-track direction of sheet 2 and capable of being driven by a motor, known in the art, but not shown. The rotation of conical drive roller 1, because of its mounting and shape, causes sheet 2, if laterally misaligned, to move both forward along a conveying path, orthogonal to shaft 4, and laterally of such path over support surface 5. This type of forward and lateral movement, imparted to sheet 2, by rotation of conical drive roller 1, is disclosed in U.S. Pat. No. 4,884,097. It should, however, be understood that other sheet drive systems, not shown, but known in the art, could also be used with the present invention to cause forward and lateral movement of sheet 2 over a support surface as heretofore explained in relation to conical drive roller 1. Therefore, without restricting the present invention to the use of a conical drive roller system, the conical drive roller system as well as the above mentioned other drive systems will hereinafter be collectively referred to as conical drive roller 1.

Lateral movement of sheet 2 ceases when sheet 2 makes contact with fixed edge guide 6 or if the embodiment being used does not have fixed edge guide 6, then when sheet 2 is in parallel contact with pivotal edge guide 8 after pivotal edge guide 8 makes contact with a stop tab 26., see FIG. 1. This ceasing of lateral movement takes place, since the lateral force that conical drive roller 1 can impart to sheet 2 is limited by the frictional force between conical roller 1 and sheet 2 and, therefore, conical drive roller 1 slips, on sheet 2, in the lateral drive direction once sheet 2 is in parallel contact with fixed edge guide 6 or if fixed edge guide 6 is not being used, is in parallel contact with pivotal edge guide 8 after pivotal edge guide 8 is against stop tab 26, since fixed edge guide 6 or pivotal edge guide 8, at that point in time, blocks any further lateral travel of sheet 2.

Figure 2:
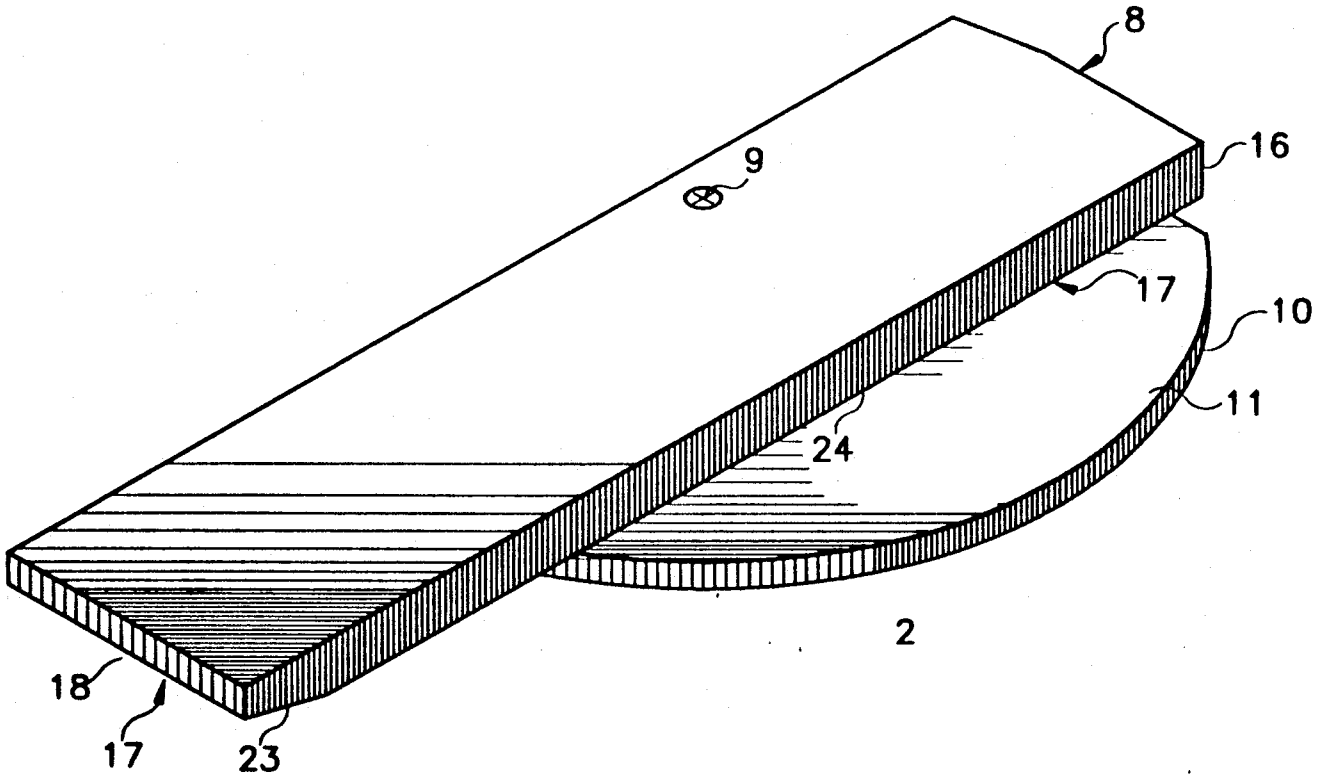
FIG. 2 is a perspective view of the pivotal edge guide in accordance with the present invention.

As shown in FIG. 2, pivotal edge guide 8 has a base plate 10, which mates with a recess, not shown, in support surface 5 such that base plate 10 may freely rotate within said recess in a counter-clockwise direction about a pivot point 9 until pivotal edge guide 8 contacts stop tab 26 located on support surface 5. Stop tab 26 is positioned such that when pivotal edge guide 8 makes contact with stop tab 26, aligning edge 14, shown in FIG. 3, of pivotal edge guide 8 is parallel to the predetermined direction of the travel of sheet 2 and in the same plane of aligning edge 6(*a*) of fixed edge guide 6 if the embodiment of the invention is being used that contains fixed edge guide 6. Since the recess in support surface 5 is as deep or deeper than the height of side edge 10(*a*), see FIG. 3, of base plate 10, the top surface 11, of base plate 10, when base plate 10 is mounted within the recess of support surface 5, is positioned below or in the same plane as top surface 19 of support surface 5. As a result, neither top surface 11 nor side edge 10(*a*) of base plate 10 interfere with the travel of sheet 2 as it is conveyed over support surface 5 in the in-track, cross-track and skew directions.

Figure 3:
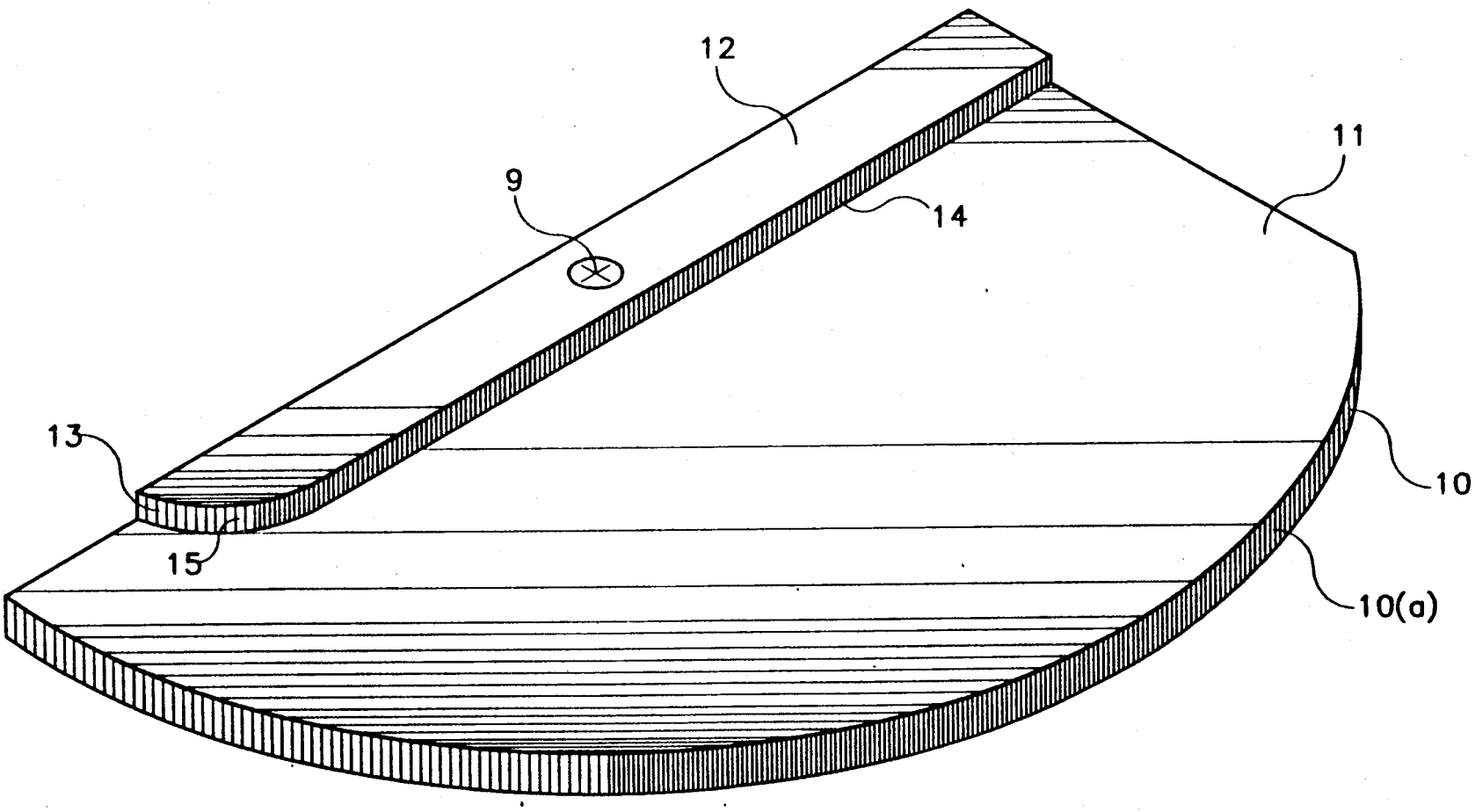
FIG. 3 is a perspective view of the lower section of the pivotal edge guide in accordance with the present invention.

Located on base plate 10, as shown in FIG. 3, is a sheet guide 12. The height of sheet guide 12, measured from the top surface 11, of base plate 10, is preferably in the range of ⅛ to ¼ inches. This range being greater than the thickness of any sheet to be used in the apparatus. A leading edge 13, of sheet guide 12, is formed as a radius. Since leading edge 13 is formed as a radius, initial point contact of sheet 2, with pivotal edge guide 8, at leading edge 13, will be at a radius, as shown in FIG. 7(*a*). This type of contact allows leading edge 13 to easily slide along side 22 of sheet 2 during the transition from initial point contact between sheet 2 and pivotal edge guide 8, to line contact between sheet 2 and pivotal edge guide 8, thereby limiting the possibility of damage to sheet 2 during its initial point contact with pivotal edge guide 8. The only force exerted between pivotal edge guide 8 and sheet 2, during the initial point contact, is the force necessary to impart angular rotation to pivotal edge guide 8. This force is minimal since pivotal edge guide 8 is manufactured by electroplating a mandril, in the shape of pivotal edge guide 8, and then removing the mandril from the electroplating with the electroplating becoming pivotal edge guide 8. This results in pivotal edge guide 8 being very light, approximately 0.5 ounces, and having a low mass moment of inertia. The likelihood of damage or marring, to even a fragile sheet 2, making contact with such a light weight pivotal edge guide 8, is therefore remote.

Once initial contact between sheet 2 and leading edge 13, of sheet guide 12, has been made, pivotal edge guide 8, because of its light weight construction, requires less force to rotate about pivot point 9 than sheet 2 requires to pivot under the pinching action applied to it by conical drive roller 1 and, therefore the radius of leading edge 13 slips about sheet 2, as opposed to sheet 2 slipping about the radius of leading edge 13. This slipping action between leading edge 13 and sheet 2 changes the initial point contact relationship between sheet 2 and leading edge 13 to a line contact relationship.

In addition to the establishment of line contact between leading edge 13 and sheet 2, as above stated, the continual feeding of sheet 2, by the rotation of conical drive roller 1, causes aligning edge 14, of pivotal edge guide 8, to pivot about pivot point 9 and align itself in parallel contact with side 22 of sheet 2, as shown in FIGS. 6(*a*)–6(*d*). Once parallel contact is established between aligning edge 14 and side 22 of sheet 2, pivotal edge guide 8 no longer continues to align itself with sheet 2, but rotates, about pivot point 9, with sheet 2, until pivotal edge guide 8 contacts stop tab 26 and aligning edge 14, of pivotal edge guide 8, is in the same plane as aligning edge 6(*a*), of fixed edge guide 6 if the embodiment of the invention having fixed edge guide 6 is being used. Once aligning edge 14 and aligning edge 6(*a*) are in the same plane or pivotal edge guide 8 contact stop tab 26, the rotation of conical drive roller 1 causes sheet 2 to move only parallel to both aligning edge 14 and aligning edge 6(*a*) of fixed edge guide 6 if the embodiment of the invention containing fixed edge guide 6 is being used. Therefore, unlike the prior art where sheets made point contact with a fixed edge guide, the initial contact between fixed edge guide 6 and sheet 2 is line contact. This reduces the chances of damage or marring to even the most fragile of sheets. With the establishment of line contact between fixed edge guide 6 and sheet 2, or with sheet 2 being in parallel contact with pivotal edge guide 8 when pivotal edge guide 8 is in contact with stop tab 26, cross-track and skew alignment of sheet 2 is assured.

As shown in FIG 2, a slot 17 is provided between base plate 10 and retaining plate 16 to restrict the vertical travel of sheet 2 along support surface 5. This prevents sheet 2 from riding over the top of aligning edge 14 as it travels along support surface 5. Front portion 18, of slot 17, has an opening greater than the height of sheet guide 12 with said opening being tapered until it is equal to the height of sheet guide 12. This tapering accommodates for the tendency of leading edge 21, of sheet 2, to rise from the surface of support surface 5 prior to reaching the point, on support surface 5, where sheet 2 is pinched between support surface 5 and conical drive roller 1. This larger slot opening is not required at side edge 24, of slot 17, since once the leading edge 21 of sheet 2 is pinched between support surface 5 and conical drive roller 1, side edge 22 of sheet 2 does not have the same or as great a tendency, as leading edge 21 had, to rise from support surface 5 prior to entering slot 17.

In operation, sheet 2 is fed by an initial transport system, known in the art, but not shown, to support surface 5. To prevent any mismatch of feed between two different drive systems, upon sheet 2 making contact with any part of conical drive roller 1, sheet 2 is released from the drive force of the initial transport system and thereafter the drive imparted to sheet 2 is solely from the rotation of conical drive roller 1. Conical drive roller 1, due to its rotation, its frictional contact with sheet 2 and its shape, causes sheet 2 to be fed forward over support surface 5 and, if sheet 2 is laterally misaligned, it also causes sheet 2 to move laterally toward pivotal edge guide 8. This lateral movement of sheet 2, toward pivotal edge guide 8, causes side 22 of sheet 2 to enter slot 17, if leading edge 21 of sheet 2 had not already entered slot 17 when sheet 2 was under the influence of the drive force of the initial transport system.

If leading edge 21, of sheet 2, is the first portion of sheet to enter slot 17, the taper 23 of slot 17 gradually causes sheet 2 to make contact with the radius of leading edge 13 of sheet guide 12, whereupon pivotal edge guide 8 begins to align itself with sheet 2. In addition, since sheet 2 is restrained in its vertical movement by slot 17, while under the drive of the initial transport system, leading edge 21 of sheet 2 is restricted in its elevation from support surface 5, before it reaches conical drive roller 1, so that the possibility of leading edge 21 not being pinched between conical drive roller 1 and support surface 5 is eliminated. Once sheet 2 aligns with pivotal edge guide 8, sheet 2, along with pivotal edge guide 8, pivots about pivot point 9, due to the feeding of sheet 2 by the initial transport system or conical driver roller 1, depending upon the position of sheet 2, on support surface 5. until pivotal edge guide 8 makes contact with stop tab 26 or sheet 2 makes line contact with fixed edge guide 6 to achieve cross-track and skew alignment. If, however, leading edge 21 of sheet 2 is past front portion 18, when sheet 2 enters slot 17, then it is side 22, of sheet 2, that is fed into slot 17 by the lateral drive of conical drive roller 1 and side 22 makes contact with aligning edge 14, of sheet guide 12. Upon side 22, of sheet 2, making contact with aligning edge 14, of pivotal edge guide 8, both pivotal edge guide 8 and sheet 2 pivot about pivot point 9 until pivotal edge guide 8 makes contact with stop tab 26 or sheet 2 makes contact with fixed edge guide 6 signifying both cross-track and skew alignment of sheet 2.

While the thickness of sheet 2 and the distortion or deformation of conical drive roller 1 are important factors to consider, since the typical sheets transported by the present transport and alignment apparatus range between 0.002 and 0.015 inches in thickness, very satisfactory alignment is achieved with such sheets when the conical drive roller 1 is positioned to provide approximately 0.125 inches radial deflection when in engagement with sheets 2.

While the invention has been described in detail with particular reference to a preferred embodiment thereof, it will be understood that variations and modifications can be effected within the spirit and scope of the invention as described hereinabove and as defined in the appended claims.

What is claimed is:

1. An apparatus for transporting and aligning a sheet in a predetermined direction of travel, said apparatus comprising:

a support surface defining a generally planar sheet transport surface extending in the predetermined direction of sheet travel;

pivotal edge guide means mounted on one side of the support surface for pivoting in a plane parallel to the sheet transport surface and aligning the sheet laterally of the predetermined direction of sheet travel; and a drive system for moving said sheet in a lateral, skew and in-track direction of sheet travel wherein said drive system is a resilient conical roller mounted for rotation on said support surface, and said drive system has means for rotatably driving said conical roller to effect movement of the sheet disposed between said support surface and said conical roller in a lateral, skew and in-track direction.

2. The apparatus of claim 1 wherein said resilient roller is distorted during contact and transport of the sheet so as to create a linear force component urging the sheet toward the pivotal edge guide means.

3. An apparatus for transporting and aligning a sheet in a predetermined direction of travel, said apparatus comprising:

a support surface defining a generally planar sheet transport surface extending in the predetermined direction of sheet travel;

pivotal edge guide means having a slot for receiving the sheet and mounted on one side of the support surface for pivoting in a plane parallel to the sheet transport surface and aligning the sheet laterally of the predetermined direction of sheet travel;

said pivotal edge guide means slot includes a front portion and a side portion and the front portion is larger than the side portion of the slot in order that the sheet may be received in the slot even if the sheet is raised from the support surface; and a drive system for moving said sheet in a lateral skew and in-track direction of sheet travel.

* * * * *